US009994802B2

(12) United States Patent
Mohsseni et al.

(10) Patent No.: US 9,994,802 B2
(45) Date of Patent: Jun. 12, 2018

(54) CLEANING INDUSTRIAL PLANT COMPONENTS TO REMOVE METAL HALIDES

(71) Applicant: WACKER CHEMIE AG, Munich (DE)

(72) Inventors: Javad Mohsseni, Leipzig (DE); Konrad Mautner, Burghausen (DE); Peter Nuernberg, Nuenchritz/OT Leckwitz (DE); Christian Kaltenmarkner, Burghausen (DE); Klaus Kaeppler, Burghausen (DE); Andreas Bockholt, Munich (DE)

(73) Assignee: WACKER CHEMIE AG, Munich (DE)

( * ) Notice: Subject to any disclaimer, the term of this patent is extended or adjusted under 35 U.S.C. 154(b) by 427 days.

(21) Appl. No.: 14/667,847

(22) Filed: Mar. 25, 2015

(65) Prior Publication Data

US 2015/0291920 A1 Oct. 15, 2015

(30) Foreign Application Priority Data

Apr. 9, 2014 (DE) ..... 10 2014 206 875

(51) Int. Cl.

| | |
|---|---|
| ***C11D 7/50*** | (2006.01) |
| ***C11D 7/32*** | (2006.01) |
| ***C11D 11/00*** | (2006.01) |
| ***B08B 3/08*** | (2006.01) |
| ***B08B 9/027*** | (2006.01) |

(52) U.S. Cl.

CPC ..... *C11D 7/5013* (2013.01); *B08B 3/08* (2013.01); *B08B 9/027* (2013.01); *C11D 7/32* (2013.01); *C11D 7/3209* (2013.01); *C11D 7/5009* (2013.01); *C11D 11/0041* (2013.01)

(58) Field of Classification Search

None

See application file for complete search history.

(56) References Cited

U.S. PATENT DOCUMENTS

| | | | | |
|---|---|---|---|---|
| 2,752,379 | A | 6/1956 | Wagner et al. | |
| 3,007,956 | A | 11/1961 | Linville et al. | |
| 3,519,458 | A | 7/1970 | Rausch et al. | |
| 3,766,241 | A * | 10/1973 | Drinkard, Jr. | C07C 253/34 558/338 |
| 4,221,674 | A | 9/1980 | Vander Mey | |
| 4,605,543 | A | 8/1986 | Lepage et al. | |
| 4,927,616 | A | 5/1990 | Marlett | |
| 4,958,040 | A | 9/1990 | Yoshioka et al. | |
| 5,493,042 | A * | 2/1996 | Ault | A62D 3/36 556/466 |
| 5,545,743 | A | 8/1996 | Cannady et al. | |
| 2004/0006201 | A1* | 1/2004 | Stanek | C08F 6/00 528/491 |
| 2004/0043610 | A1* | 3/2004 | Yates | H01L 21/02071 438/683 |
| 2004/0261823 | A1 | 12/2004 | de Larios | |
| 2011/0046032 | A1* | 2/2011 | Stepp | C01B 33/107 510/109 |
| 2013/0310297 | A1 | 11/2013 | Vauthrin et al. | |

FOREIGN PATENT DOCUMENTS

| | | | |
|---|---|---|---|
| CN | 101029289 | A | 9/2007 |
| CN | 103046055 | A | 4/2013 |
| CN | 103119148 | A | 5/2013 |
| EP | 0 266 758 | B1 | 1/1993 |
| EP | 1 193 309 | A1 | 4/2002 |
| FR | 1 096 783 | | 6/1955 |
| GB | 755 753 | | 8/1956 |
| JP | 30-2770 | | 4/1955 |
| JP | 39-1417 | | 2/1964 |
| JP | 62-230793 | A | 10/1987 |
| JP | 8-291180 | A | 11/1996 |
| JP | 9-194483 | | 7/1997 |
| JP | 10-87670 | A | 4/1998 |
| JP | 2002-219432 | A | 8/2002 |
| JP | 2009518430 | A | 5/2009 |
| WO | 2007/067723 | A1 | 6/2007 |
| WO | 2010/009305 | A2 | 1/2010 |
| WO | 2011/107924 | A1 | 9/2011 |
| WO | 2015088741 | A1 | 6/2015 |

OTHER PUBLICATIONS

Emons, H.H., "Zur Solvatation von Aluminium (III)-chlorid in Acetonitril und Acetonitril-Wasser-Gemischen (Ramanspektroskopische Untersuchungen)", Zeitschrift fuer anorganische und allgemeine Chemie, Weinheim: Wiley-VCH, ISSN 0372-7874, vol. 511 (1984), pp. 148 and English Abstract.

Plummer, Daniel Tear, "Synthesis of multidentate nitrile and isonitrile ligands and their transition-metal complex" (1983). Retrospective Theses and Dissertations, Paper 7686. Available Online at: http://lib.dr.iastate.edu/cgi/viewcontent.cgi?article=86858,context=rtd.

* cited by examiner

*Primary Examiner* — Nicole Blan

(74) *Attorney, Agent, or Firm* — Brooks Kushman P.C.

(57) ABSTRACT

Cleaning industrial plant components to remove silane, metal halide, and organometallic halide contaminants and mixtures thereof, involves treating the plant components with a liquid nitrile or amine or mixture thereof or with a solution of a nitrile or amine or mixture thereof in an aprotic solvent.

9 Claims, No Drawings

CLEANING INDUSTRIAL PLANT COMPONENTS TO REMOVE METAL HALIDES

CROSS-REFERENCE TO RELATED APPLICATIONS

This application claims priority to German Patent Application No. 10 2014 206 875.4 filed Apr. 9, 2014 which is herein incorporated by reference.

BACKGROUND OF THE INVENTION

1. Field of the Invention

The invention relates to a method of cleaning industrial plant components to remove silanes, metal halides and organometallic halides, using a nitrile or amine.

2. Background Art

Many crude industrial products and industrial product mixtures, such as direct synthesis (Müller-Rochow synthesis) mixtures, comprising chlorosilanes and methylchlorosilanes, or the chlorosilane mixtures obtained from hydrochlorination of metallurgical silicon, may comprise silanes, metal halides and organometallic halides, particularly $AlCl_3$. The silanes present in the crude silanes are separated into pure silanes by multi-stage distillation. The aforementioned impurities in the crude silanes form deposits in the pipes causing problems which may even culminate in blockage of the lines. The lines thus require dismantling and cleaning, e.g. with water, at regular intervals. This method of cleaning has two disadvantages. The first is cost and inconvenience. Disassembly, cleaning and reassembly of lines is costly and very time consuming. The second disadvantage of cleaning with water is the formation, by hydrolysis of chlorosilane residues, metal chlorides, and/or organometallic halides and/or mixtures of metal halides/organometallic halides, of hydrochloric acid which attacks the pipes. Acetonitrile is described as a solvent for aluminum chloride [Zeitschrift für anorganische und allgemeine Chemie. Weinheim: Wiley-VCH, ISSN 0372-7874 Vol. 511 (4. 1984), p. 148].

SUMMARY OF THE INVENTION

The invention provides a method of cleaning industrial plant components to remove contaminants selected from silanes, metal halides, organometallic halides and mixtures thereof wherein said method comprises treating the plant components with a liquid nitrile or amine or mixtures thereof or with a solution of a nitrile or amine or mixtures thereof in an aprotic solvent.

DETAILED DESCRIPTION OF THE PREFERRED EMBODIMENT(S)

Contaminants, particularly metal halides, form deposits in plant components. The contaminants are easily dissolved out from the industrial plant components with nitriles or amines. The deposits in the lines are incipiently or fully dissolved and sluiced out. After cleaning, the plant components are dried and brought back on stream. The cleaning residues may simply be sluiced out and properly disposed of, for example by incineration.

Cleaning plant components with nitriles or amines obviates the need for costly and time-consuming disassembly and cleaning with water. The useful life of the plant components is extended since the lines no longer come into contact with acidic water.

The contaminants are in particular metal halides and organometallic halides which form acids on hydrolysis with water, particularly organometallic chlorides. Examples include chlorides and organometallic chlorides of iron, such as $FeCl_2$, $FeCl_3$, cobalt, nickel, chromium, titanium, copper, tin, zinc and preferably $AlR_xCl_{3-x}$, where R is an organo or organosilane function, particularly methyl, and x is 0, 1, or 2, particularly $AlCl_3$.

Preferably employed nitriles are nitriles of mono- or polycarboxylic acids preferably comprising from 2 to 20 carbon atoms, more particularly from 5 to 12 carbon atoms. Preference is given to nitriles of aliphatic saturated monocarboxylic acids, such as acetic, propionic, butyric, valeric and caproic acids and of fatty acids comprising up to 18 carbon atoms. Preference is also given to dinitriles of aliphatic saturated dicarboxylic acids, such as malonic, succinic, glutaric, adipic, pimelic and suberic acids. Preference is given to nitriles having a boiling point of at least 120° C. at 1013 hPa, more particularly at least 150° C. at 1013 hPa.

Particular preference is given to adiponitrile which has a boiling point of 295° C. at 1013 hPa and displays a strong complexing affinity for metal ions due to its two nitrile groups. Adiponitrile is an important intermediate in polyamide production and is thus widely available and inexpensive.

The amines are preferably selected from primary, secondary and tertiary aliphatic and aromatic amines. Polyamines comprising not only primary and secondary but also tertiary amine functions may be employed as well as monoamines.

Preferred monoamines conform to general formula (I)

$$NR^1R^2R^3 \quad \text{(I)},$$

where $R^1$, $R^2$, $R^3$ are H or a monovalent $C_1$-$C_{30}$ hydrocarbon radical optionally substituted by substituents selected from F—, Cl—, OH— and $OR^4$ where nonadjacent —$CH_2$— units of the $R^1$, $R^2$, and $R^3$ radicals are optionally substituted by units selected from —C(═O)— and —O—, and $R^4$ is a $C_1$-$C_{10}$ alkyl radical.

The monovalent hydrocarbon radicals $R^1$, $R^2$, $R^3$ may be linear, cyclic, branched, aromatic, saturated or unsaturated. The hydrocarbon radicals $R^1$, $R^2$, $R^3$ preferably comprise from 1 to 20 carbon atoms, particular preference being given to alkyl radicals comprising from 1 to 6 carbon atoms, alkylaryl radicals, arylalkyl radicals each and phenyl radicals.

Preferred polyamines conform to general formula (II)

$$R^5{}_2N—(CR^6{}_2)_a—(NR^7—(CR^6{}_2)_b)_c—NR^5{}_2 \quad \text{(II)},$$

where $R^5$, $R^6$, $R^7$ are H or $C_1$-$C_{18}$ hydrocarbon radicals optionally substituted by substituents selected from F—, Cl— and OH— where nonadjacent —$CH_2$— units of the $R^5$, $R^6$, and $R^7$ radicals are optionally substituted by units selected from —C(═O)— and —O—, a, b are integers of from 1 to 6, and c is 0 or an integer of from 1 to 40.

a, b are preferably 2 or 3.

c is preferably an integer of from 1 to 6.

Preferably, a and b are identical.

Examples of particularly preferred polyamines (A) of general formula (II) include:

diethylenetriamine ($H_2N—CH_2CH_2—NH—CH_2CH_2—NH_2$), triethylenetetramine ($H_2N—CH_2CH_2—(NH—CH_2CH_2—)_2—NH_2$),
tetraethylenepentamine ($H_2N—CH_2CH_2—(NH—CH_2CH_2—)_3—NH_2$),
pentaethylenehexamine ($H_2N—CH_2CH_2—(NH—CH_2CH_2—)_4—NH_2$),
hexaethyleneheptamine ($H_2N—CH_2CH_2—(NH—CH_2CH_2—)_5—NH_2$), and
mixtures of the abovementioned amines, such as are commercially available as industrial products, for example AMIX1000® (BASF SE).

Examples of further preferred monoamines and polyamines include octylamine, nonylamine, decylamine, undecylamine, dodecylamine (laurylamine), tridecylamine, tridecylamine (isomer mixture), tetradecylamine (myristylamine), pentadecylamine, hexadecylamine (cetylamine), heptadecylamine, octadecylamine (stearylamine), 4-hexylaniline, 4-heptylaniline, 4-octylaniline, 2,6-diisopropylaniline, 4-ethoxyaniline, N-methylaniline, N-ethylaniline, N-propylaniline, N-butylaniline, N-pentylaniline, N-hexylaniline, N-octylaniline, N-cyclohexylaniline, dicyclohexylamine, p-toluidine, indoline, 2-phenylethylamine, 1-phenylethylamine, N-methyldecylamine, benzylamine, N,N-dimethylbenzylamine, 1-methylimidazole, 2-ethylhexylamine, dibutylamine, dihexylamine, di-(2-ethylhexylamine), 3,3'-dimethyl-4,4'-diaminodicyclohexylmethane, 4,4'-diaminodicyclohexylmethane, ditridecylamine (isomer mixture), isophoronediamine, N,N,N',N'-tetramethyl-1,6-hexanediamine, N,N-dimethylcyclohexylamine, octamethylenediamine, 2,6-xylidine, 4,7,10-trioxatridecane-1,13-diamine, 4,9-dioxadodecane-1,12-diamine, di-(2-methoxyethyl)amine, bis(2-dimethylaminoethyl) ether, Polyetheramin D230® (BASF SE), 2-(diisopropylamino)ethylamine, pentamethyldiethylenetriamine, N-(3-aminopropyl)imidazole, 1,2-dimethylimidazole, 2,2'-dimorpholino diethyl ether, dimethylaminoethoxyethanol, bis(2-dimethylaminoethyl) ether, Lupragen®N600—S-triazine (BASF AG), 1,8-diazabicyclo-5,4,0-undec-7-ene (DBU), 3-(2-aminoethylamino)propylamine, 3-(cyclohexylamino)propylamine, dipropylenetriamine, N4-Amin (N,N'-bis(3-aminopropyl) ethylenediamine), AMIX M (BASF AG) (=high-boiling morpholine derivatives), 1-(2-hydroxyethyl)piperazine, 2-(2-aminoethoxy)ethanol, 3-amino-1-propanol, 3-dimethylaminopropan-1-ol, 4-(2-hydroxyethyl)morpholine, butyldiethanolamine, N-butylethanolamine, N,N-dibutylethanolamine, N,N-diethylethanolamine, dimethylaminoethoxyethanol (Lupragen®N107, BASF AG), methyldiethanolamine, diethanolamine, triethanolamine, diisopropanolamine, triisopropanolamine, 1-vinylimidazole, 1-hexylimidazole, 1-octylimidazole, 1-(2-ethylhexyl)imidazole, and triisooctylamine.

Preference is given to amines having a boiling point of at least 120° C. at 1013 hPa, more particularly at least 150° C. at 1013 hPa.

When solutions of nitriles or amines or mixtures of nitriles and amines in aprotic solvents are employed, preference is given to using solvents or solvent mixtures having a boiling point or boiling range of up to 120° C. at 1013 hPa. Examples of such solvents include ethers, such as dioxane, tetrahydrofuran, diethyl ether, diisopropyl ether, diethylene glycol dimethyl ether; chlorinated hydrocarbons such as dichloromethane, trichloromethane, tetrachloromethane, 1,2-dichloroethane, trichloroethylene; hydrocarbons, such as pentane, n-hexane, hexane isomer mixtures, heptane, octane, solvent naphtha, petroleum ether, benzene, toluene, xylenes; siloxanes, in particular linear dimethylpolysiloxanes comprising trimethylsilyl end groups preferably comprising from 0 to 6 dimethylsiloxane units, or cyclic dimethylpolysiloxanes preferably comprising from 4 to 7 dimethylsiloxane units, for example hexamethyldisiloxane, octamethyltrisiloxane, octamethylcyclotetrasiloxane and decamethylcyclopentasiloxane; ketones, such as acetone, methyl ethyl ketone, diisopropyl ketone, methyl isobutyl ketone (MIBK); esters, such as ethyl acetate, butyl acetate, propyl propionate, ethyl butyrate, ethyl isobutyrate; carbon disulfide and nitrobenzene, or mixtures thereof.

The concentration of the nitriles and/or amines in the aprotic solvents is preferably at least 1 g/l, more preferably at least 5 g/l, and most preferably at least 10 g/l.

The method is preferably carried out at a temperature of from 0° C. to 100° C., more preferably from 15° C. to 30° C., and at a pressure of from 500 hPa to 2000 hPa, more preferably from 900 hPa to 1200 hPa.

One particular embodiment comprises cleaning plant components in which silanes selected from chlorosilanes and methylchlorosilanes are processed. $AlR_xCl_{3-x}$, in particular $AlCl_3$, is removed from these plant components with high-boiling organochlorosilanes. Acetonitrile is less suitable for these plant components since acetonitrile has a boiling point of 82° C. at 1013 hPa and thus also has an appreciable vapor pressure at room temperature. Its high vapor pressure hampers the use of acetonitrile in pipe cleaning since acetonitrile is flammable. In addition, acetonitrile must not become entrained in silane mixtures of the distillation since its boiling point is very close to that of chlorosilanes and methylchlorosilanes and the acetonitrile would then itself become an impurity. These plant components are cleaned using nitriles alone or in combination with aprotic solvents having a boiling point of at least 120° C. at 1013 hPa. Particular preference is given to adiponitrile.

Examples of plant components include pipes, stirred tanks, tubular reactors, distillation columns and internals and packings thereof, thin film evaporators, falling film evaporators, short path distillation apparatuses including internals thereof, for example wipers in thin film evaporators, but also heat exchangers and vessels, such as tanks and flasks.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of cleaning industrial plant components to remove silane, and to remove metal halide and/or organometallic halide contaminants, comprising treating the plant components with a liquid consisting of a liquid nitrile or a liquid consisting of a solution of a nitrile in an aprotic solvent, wherein the silane contaminants comprise at least one of chlorosilane or methylchlorosilane, and wherein $AlCl_3$ is present, and removing $AlCl_3$ by means of the liquid consisting of the liquid nitrile or by the liquid consisting of a nitrile in an aprotic solvent.

2. The method of claim 1, wherein at least one chloride of iron, cobalt, nickel, chromium, titanium, copper, tin or zinc is also present as the metal halide contaminant.

3. The method of claim 1, wherein at least one organometallic chloride of iron, cobalt, nickel, chromium, titanium, copper, tin, zinc, or aluminum is also present as the organometallic halide contaminant.

4. The method of claim 1, wherein at least one nitrile of a mono- or polycarboxylic acid comprising from 2 to 20 carbon atoms is used as the nitrile in solution in an aprotic solvent or as the liquid nitrile.

5. The method of claim 1, wherein the liquid consisting of a solution of at least one nitrile in an aprotic solvent employs an aprotic solvent selected from the group consisting of ethers, chlorinated hydrocarbons, hydrocarbons, siloxanes, ketones, esters, carbon disulphide, nitrobenzene, and mixtures thereof.

6. The method of claim 1, wherein the aprotic solvent has a boiling point of at least 120° C. at 1013 hPa.

7. The method of claim 1, wherein adiponitrile is employed as the liquid nitrile.

8. The method of claim 1, wherein the plant components are one or more of pipes, stirred tanks, tubular reactors, distillation columns and internals and packings thereof, thin film evaporators, falling film evaporators, short path distillation apparatuses including internals thereof, heat exchangers and vessels.

9. The method of claim 1, wherein the liquid consists of a liquid nitrile.

* * * * *